US007267062B1

(12) United States Patent
Samilo

(10) Patent No.: US 7,267,062 B1
(45) Date of Patent: Sep. 11, 2007

(54) ADJUSTABLE PILE HEIGHT MECHANISM AND METHOD FOR ADJUSTING THE PILE HEIGHT OF A TUFTED FLOOR COVERING

(75) Inventor: John Samilo, Ringgold, GA (US)

(73) Assignee: CYP Technologies, LLC, Chattanooga, TN (US)

( * ) Notice: Subject to any disclaimer, the term of this patent is extended or adjusted under 35 U.S.C. 154(b) by 119 days.

(21) Appl. No.: 11/216,992

(22) Filed: Aug. 31, 2005

(51) Int. Cl.
*D05C 15/14* (2006.01)
*D05B 73/12* (2006.01)

(52) U.S. Cl. ..... 112/80.3; 112/260

(58) Field of Classification Search ..... 112/80.3, 112/80.33, 80.54, 260, 217.3, 80.42, 80.32; 74/25, 49, 55, 559, 567, 569; 108/6, 8; 428/454, 428/455, 157, 420, 188.2; 312/208.1; 400/492
See application file for complete search history.

(56) References Cited

U.S. PATENT DOCUMENTS

| | | | | |
|---|---|---|---|---|
| 1,452,632 | A | 4/1923 | Barnett | |
| 1,855,175 | A | 4/1932 | Braudes | |
| 2,058,047 | A | 10/1936 | Warren | |
| 2,314,339 | A | 3/1943 | Bradwell | |
| 2,389,914 | A | 11/1945 | Kile | |
| 2,848,859 | A * | 8/1958 | Abel | 56/17.2 |
| 2,977,905 | A | 4/1961 | Cobble, Sr. et al. | |
| 3,332,379 | A | 7/1967 | Cobble, Sr. et al. | |
| 3,440,987 | A * | 4/1969 | Coulombe | 112/260 |
| 3,599,585 | A * | 8/1971 | Myrick | 112/217.3 |
| 3,881,432 | A | 5/1975 | Dodd et al. | |
| 4,384,540 | A | 5/1983 | Vollmar et al. | |
| 4,515,096 | A * | 5/1985 | Ingram | 112/80.42 |
| 4,781,126 | A * | 11/1988 | Lochridge | 108/6 |
| 4,867,080 | A * | 9/1989 | Taylor et al. | 112/80.32 |
| 4,991,523 | A | 2/1991 | Ingram | |
| 5,080,028 | A | 1/1992 | Ingram | |
| 5,158,027 | A | 10/1992 | Ingram | |
| 5,165,352 | A | 11/1992 | Ingram | |
| 5,191,943 | A * | 3/1993 | Minor et al. | 172/393 |
| 5,205,233 | A | 4/1993 | Ingram | |
| 5,562,056 | A | 10/1996 | Christman, Jr. | |
| 5,564,844 | A * | 10/1996 | Patterson et al. | 400/492 |
| 7,086,361 | B2 * | 8/2006 | Ritter | 123/90.51 |

* cited by examiner

*Primary Examiner*—Ismael Izaguirre
(74) *Attorney, Agent, or Firm*—Chambliss, Bahner & Stophel, PC

(57) ABSTRACT

An adjustable pile height mechanism for producing a tufted floor covering comprising an adjustable bed plate, a cam shaft, and a plurality of eccentric cams mounted on the cam shaft so as to contact the bed plate. The cam shaft is adapted to be rotated so as to rotate the cams, and the rotational movement of the cams raises and lowers the bed plate so as to adjust the pile height of the floor covering. A method for adjusting the pile height of a floor covering further comprises the steps of loosening the presser foot bracket bolt, raising the presser foot assembly, tightening the presser foot bracket bolt, disengaging the clamp assembly, rotating the cam shaft so as to adjust the bed plate to the desired pile height, engaging the clamp assembly, loosening the presser foot bracket bolt, lowering the presser foot assembly, and tightening the presser foot bracket bolt.

20 Claims, 7 Drawing Sheets

ADJUSTABLE PILE HEIGHT MECHANISM AND METHOD FOR ADJUSTING THE PILE HEIGHT OF A TUFTED FLOOR COVERING

FIELD OF THE INVENTION

This invention relates generally to methods and devices for producing a tufted floor covering and more particularly to methods and devices for adjusting the pile height of a tufted floor covering.

BACKGROUND AND DESCRIPTION OF THE PRIOR ART

It is known to employ a tufting machine to produce a tufted floor covering. It is also known to use an adjustable tufting machine for adjusting the pile height of a tufted floor covering. See, e.g., U.S. Pat. No. 3,881,432 of Dodd, et al.; U.S. Pat. No. 5,562,056 of Christman, Jr.; and U.S. Pat. No. 3,332,379 of Cobble, Sr. However, such conventional adjustable tufting machines suffer from several disadvantages. For example, conventional adjustable tufting machines are complex in construction. The adjustment of the pile height produced by conventional adjustable tufting machines is time consuming and labor intensive. In addition, conventional adjustable tufting machines do not permit the user to adjust the pile height of a tufted floor covering to any desired pile height within a range of pile heights.

It would be desirable, therefore, if a method and apparatus for an adjustable pile height mechanism could be provided that would be less complex in construction. It would also be desirable if such a method and apparatus could be provided that would permit less time consuming and less labor intensive adjustment of the pile height for a tufted floor covering. It would be further desirable if such a method and apparatus could be provided that would permit the user to adjust the pile height of a tufted floor covering to an infinite number of desired pile heights within a range of pile heights.

ADVANTAGES OF THE PREFERRED EMBODIMENTS OF THE INVENTION

Among the advantages of the preferred embodiments of the invention is providing a method and an apparatus for an adjustable pile height mechanism that is less complex in construction than conventional devices. It is also an advantage of the preferred embodiments of the invention to provide a method and apparatus for adjusting the pile height of a tufted floor covering that is less time consuming and less labor intensive than conventional methods and devices. It is a further advantage of the preferred embodiments of the invention to provide such a method and apparatus that permits the user to adjust the pile height of a tufted floor covering to an infinite number of desired pile heights within a range of pile heights.

Explanation of Technical Terms

As used herein, the term "clamp assembly" refers to any suitable assembly or construction adapted to control the rotational movement of the cam shaft. The term "clamp assembly" includes assemblies and constructions adapted to be engaged so as to lock the cam shaft into a fixed position such that rotational movement of the cam shaft is prevented and disengaged so as to unlock the cam shaft such that the cam shaft may be rotated. It is contemplated within the scope of the invention that the "clamp assembly" may be operably connected to the hand wheel, the gear assembly and/or the cam shaft. It is further contemplated that the "clamp assembly" may be engaged and disengaged manually by a user or automatically by a motor and control device (such as a computer) arrangement or the like.

As used herein, the term "eccentric cam" refers to any eccentric wheel, disc and the like adapted to be rotated so as to adjust the height of the adjustable bed plate. The term "eccentric cam" includes eccentric wheels, discs and the like having a non-linear or curved outer surface that is adapted to permit the adjustment of the height of the adjustable bed plate to effect an infinite number of desired pile heights within a range of pile heights.

As used herein, the term "gear assembly" refers to any suitable assembly or construction adapted to transmit force and motion between the hand wheel and the cam shaft. The term "gear assembly" may include one or more moving parts such as a toothed wheel or disc that is adapted to mesh with the teeth in a different wheel or disc so as to transmit force and motion between the hand wheel and the cam shaft. It is contemplated within the scope of the invention, however, that the term "gear assembly" may include any suitable system for transmitting force and motion between the hand wheel and the cam shaft. It is further contemplated that the "gear assembly" may be operated by mechanical force applied manually by a user or automatically by a motor and control device (such as a computer) arrangement or the like.

As used herein, the term "hand wheel" refers to any suitable structure adapted to effect rotational movement of the cam shaft. The term "hand wheel" includes structures that are generally circular in shape, but it is also contemplated within the scope of the invention that the term "hand wheel" includes structures having any suitable shape for effecting rotational movement in the cam shaft such as ovate, polygonal, eccentric, and the like. It is further contemplated within the scope of the invention that the term "hand wheel" may include structures that are generally shaped like a rod, a tube, a cylinder, an arc, a letter "C", a letter "D", a letter "L", a letter "T", a letter "U", a letter "V", a letter "X" and the like. It is still further contemplated within the scope of the invention that the term "hand wheel" includes structures that are adapted to effect rotational movement of the cam shaft through a mechanical force applied manually by a user or automatically by a motor and control device (such as a computer) arrangement or the like.

As used herein, the term "pile height gauge" refers to any suitable device adapted to identify the pile height of the tufted floor covering produced by the adjustable pile height mechanism. The term "pile height gauge" includes mechanical devices such as a dial plate and pointer arrangement as well as electronic devices such as liquid crystal displays (LCDs), light-emitting diode (LED) displays and the like. It is contemplated within the scope of the invention that the "pile height gauge" may be controlled manually by a user or automatically by a control device such as a computer.

SUMMARY OF THE INVENTION

The invention comprises an adjustable pile height mechanism for producing a tufted floor covering. The adjustable pile height mechanism comprises an adjustable bed plate, a cam shaft, and a plurality of eccentric cams mounted on the cam shaft so as to be adapted to contact the adjustable bed plate. The cam shaft is adapted to be rotated so as to rotate the plurality of eccentric cams, and the rotational movement of the plurality of eccentric cams raises and lowers the adjustable bed plate so as to adjust the pile height of the tufted floor covering.

In a preferred embodiment of the apparatus of the invention, the adjustable bed plate comprises a top bed plate and a bottom bed plate wherein the top bed plate is hingedly connected to the bottom bed plate such that the top bed plate is adapted to be pivotally raised and lowered relative to the bottom bed plate. Also in the preferred embodiment of the apparatus of the invention, the cam shaft is operably connected to a hand wheel by a gear assembly, and the plurality of eccentric cams are mounted on the cam shaft so as to be uniformly spaced along the cam shaft and so as to be adapted to contact the top bed plate. The preferred apparatus of the invention also includes a clamp assembly for controlling the rotational movement of the cam shaft, a handle provided on the hand wheel, a presser foot assembly including a presser foot bracket bolt, and a pile height gauge adapted to identify the pile height of the tufted floor covering.

The invention also comprises a method for adjusting the pile height of a tufted floor covering. The method comprises providing an adjustable pile height mechanism for producing a tufted floor covering. The adjustable pile height mechanism comprises an adjustable bed plate, a cam shaft, a clamp assembly for controlling the rotational movement of the cam shaft, a plurality of eccentric cams mounted on the cam shaft so as to be adapted to contact the adjustable bed plate, and a presser foot assembly having a presser foot bracket bolt. The cam shaft is adapted to be rotated so as to rotate the plurality of eccentric cams, and the rotational movement of the plurality of eccentric cams raises and lowers the adjustable bed plate so as to adjust the pile height of the tufted floor covering. The method further comprises the steps of loosening the presser foot bracket bolt, raising the presser foot assembly, tightening the presser foot bracket bolt, disengaging the clamp assembly, rotating the cam shaft so as to adjust the adjustable bed plate to the desired pile height, engaging the clamp assembly, loosening the presser foot bracket bolt, lowering the presser foot assembly, and tightening the presser foot bracket bolt.

In a preferred embodiment, the method further comprises providing an adjustable pile height mechanism having a cam shaft that is operably connected to a hand wheel by a gear assembly and a pile height gauge adapted to identify the pile height of the tufted floor covering. Also in the preferred embodiment of the invention, the method comprises providing an adjustable pile height mechanism having a top bed plate and a bottom bed plate wherein the top bed plate is hingedly connected to the bottom bed plate such that the top bed plate is adapted to be pivotally raised and lowered relative to the bottom bed plate.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
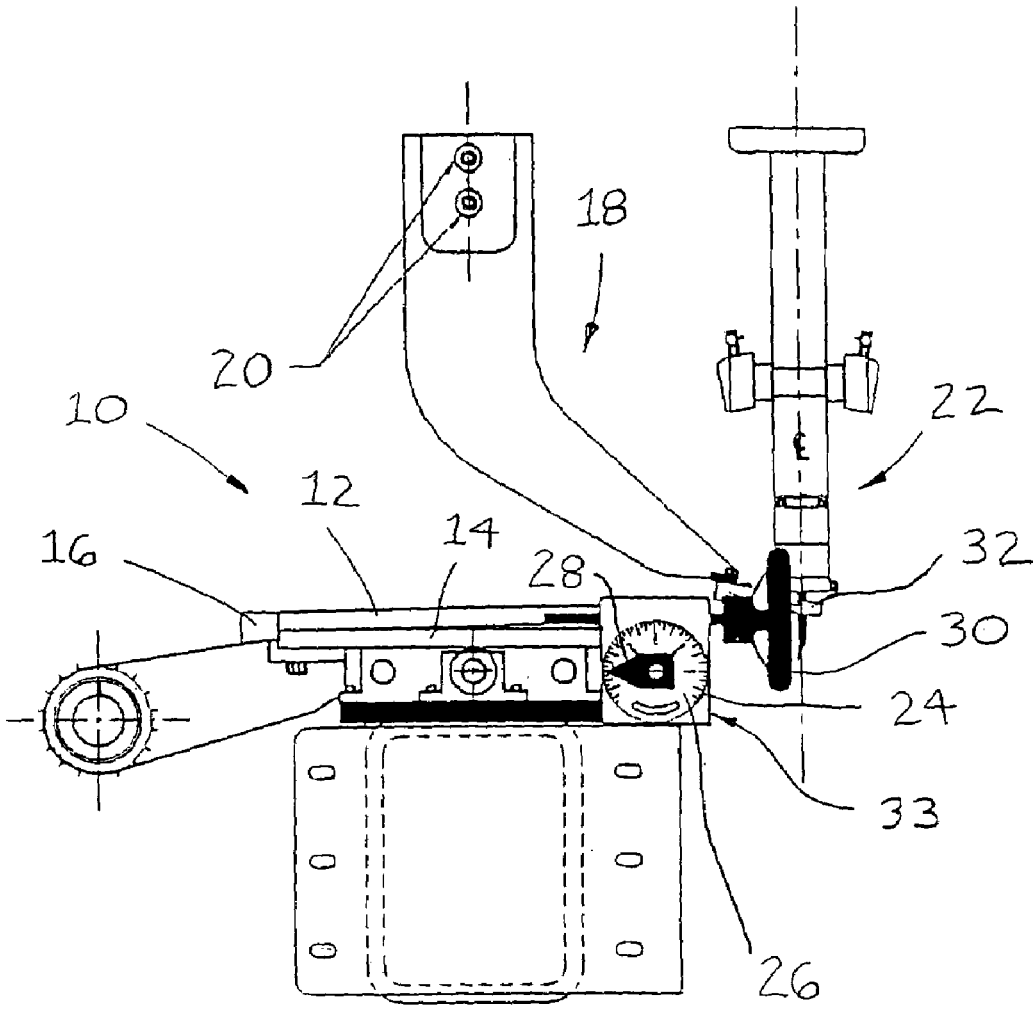
FIG. 1 is a right side view of the preferred embodiment of the adjustable pile height mechanism in accordance with the present invention.

Referring now to the drawings, the preferred embodiments of the invention are illustrated by FIGS. 1 through 8. As shown in FIG. 1, the preferred adjustable pile height mechanism for producing a tufted floor covering is referred to generally by reference numeral 10. More particularly, FIG. 1 is a right side view of the preferred adjustable pile height mechanism 10. The preferred adjustable pile height mechanism 10 includes an adjustable bed plate comprising top bed plate 12 and bottom bed plate 14. The preferred top bed plate 12 is adapted to provide vertical support to the substrate of the tufted floor covering being produced by adjustable pile height mechanism 10. The preferred top bed plate 12 is pivotally connected to bottom bed plate 14 by hinge 16. It is contemplated within the scope of the invention, however, that any suitable device may be used to adjustably connect the top bed plate to the bottom bed plate or some other support structure such as a frame. As discussed in more detail below, the preferred top bed plate 12 is adapted to be pivotally raised and lowered relative to the bottom bed plate 14 so as to adjust the pile height of the tufted floor covering being produced by adjustable pile height mechanism 10.

Still referring to FIG. 1, the preferred adjustable pile height mechanism 10 also includes presser foot assembly 18 having a plurality of presser foot bracket bolts 20. The preferred presser foot assembly 18 is adapted to prevent the upward movement of the substrate of the tufted floor covering as needle assembly 22 moves upwardly relative to the substrate. As discussed below, the preferred presser foot assembly 18 is adapted to be raised and lowered relative to the substrate of the tufted floor covering being produced by adjustable pile height mechanism 10. The preferred adjustable pile height mechanism 10 further includes pile height gauge 24, having dial face plate 26 and pointer 28, and hand wheel 30 having handle 32. The preferred pile height gauge 24 is adapted to identify the pile height of the tufted floor covering being produced by adjustable pile height mechanism 10. It is contemplated within the scope of the invention, however, that the pile height gauge may be any suitable device for identifying the pile height of the floor covering being produced by the preferred adjustable pile height mechanism.

Referring still to FIG. 1, the preferred adjustable pile height mechanism 10 further includes hand wheel 30 having handle 32. The preferred hand wheel 30 and handle 32 are adapted to permit the user to transmit mechanical force and motion to a cam shaft (see FIG. 3) as discussed below. However, it is contemplated within the scope of the invention that force and motion may be transmitted to the cam shaft by any suitable device including devices that are manually operated and devices that are automatically operated. The preferred gear assembly 33 (see also FIG. 6) is operably connected to the cam shaft and hand wheel 30 and is adapted to rotate the cam shaft upon rotation of the hand wheel.

Figure 2:
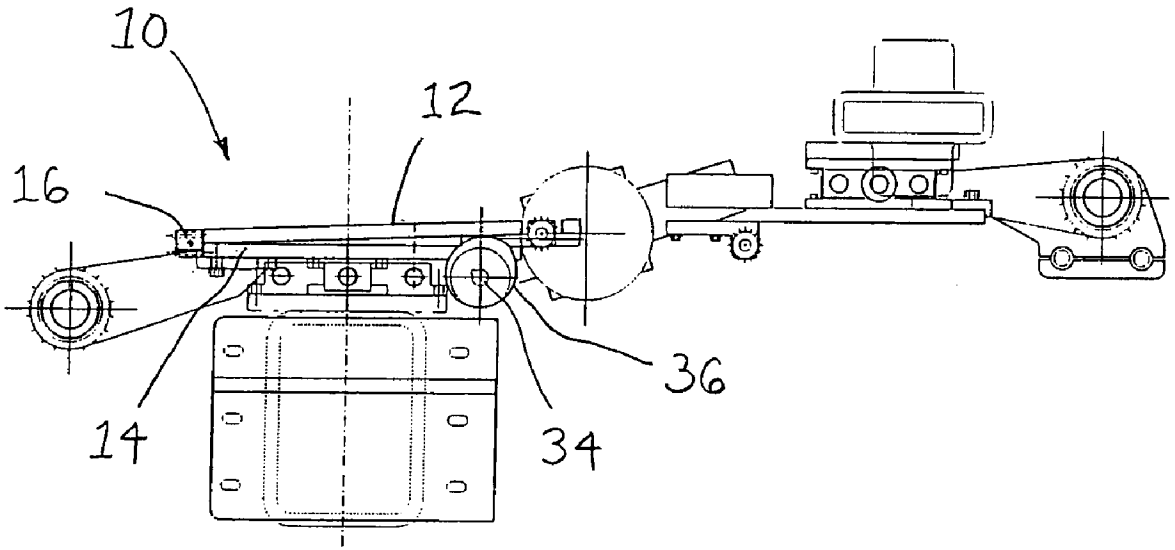
FIG. 2 is a partial sectional right side view of the preferred embodiment of the adjustable pile height mechanism in accordance with the present invention.

Referring now to FIG. 2, a partial sectional right side view of the preferred embodiment of the adjustable pile height mechanism 10 is illustrated. As shown in FIG. 2, the preferred adjustable pile height mechanism 10 includes cam shaft 34 and a plurality of eccentric cams 36 mounted on the cam shaft so as to be adapted to contact top bed plate 12 (see also FIG. 3). The preferred cam shaft 34 is adapted to be rotated so as to rotate the plurality of eccentric cams. The rotational movement of the preferred plurality of eccentric cams 36 raises and lowers the top bed plate so as to adjust the pile height of the tufted floor covering. The preferred cam shaft 34 is operably connected to hand wheel 30.

Figure 3:
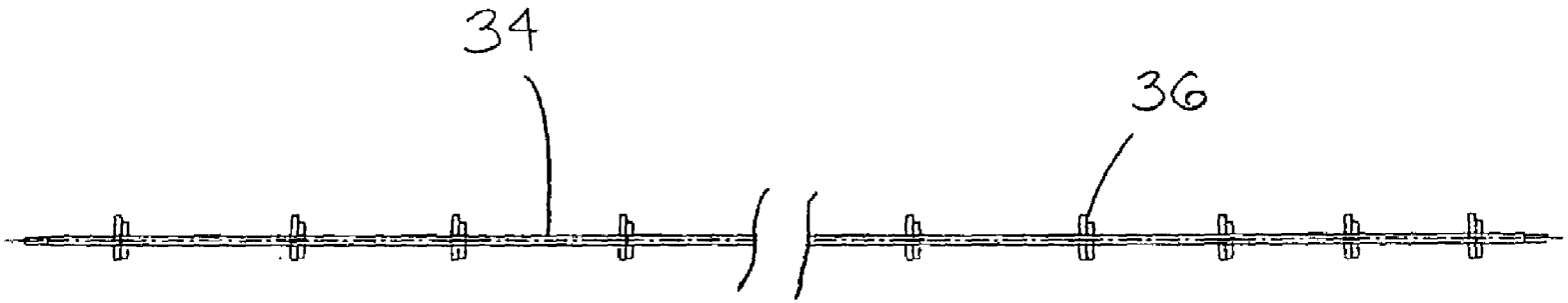
FIG. 3 is a front view of the preferred cam shaft and the preferred plurality of eccentric cams of the preferred adjustable pile height mechanism in accordance with the present invention.

Referring now to FIG. 3, a front view of the preferred cam shaft 34 and the preferred plurality of eccentric cams 36 is illustrated. As shown in FIG. 3, the preferred plurality of eccentric cams 36 are mounted on cam shaft 34 so as to be uniformly spaced along the length of the cam shaft and the length of top bed plate 12. While FIG. 3 illustrates the preferred configuration and arrangement of the plurality of eccentric cams 36 and cam shaft 34, it is contemplated within the scope of the invention that the configuration and arrangement of the plurality of eccentric cams 36 and cam shaft 34 may be any suitable configuration and arrangement adapted to effect the adjustment of the adjustable bed plate.

Figure 4:
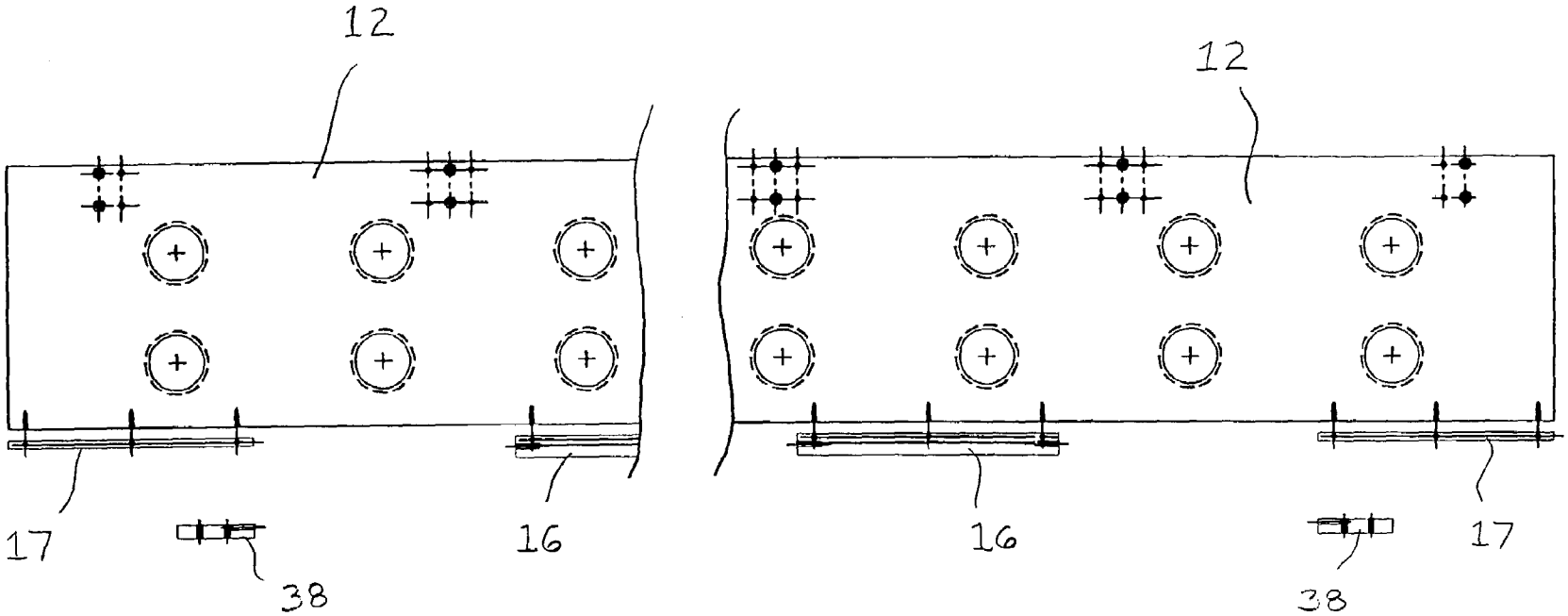
FIG. 4 is a top view of the preferred top bed plate of the preferred adjustable pile height mechanism in accordance with the present invention.

Referring now to FIG. 4, a top view of the preferred top bed plate 12 of adjustable pile height mechanism 10 is illustrated. As shown in FIG. 4, the preferred top bed plate 12 is generally rectangular in configuration. The preferred top bed plate 12 is at least approximately six feet in length. In another preferred embodiment, top bed plate 12 is at least approximately twelve feet in length. While FIG. 4 illustrates the preferred configuration and arrangement of the top bed plate, it is contemplated within the scope of the invention that the top bed plate may be configured and arranged in any suitable manner.

Referring still to FIG. 4, a plurality of hinges are pivotally connected to one lengthwise side of top bed plate 12 so as to permit the pivotal movement of the top bed plate relative to the bottom bed plate. Preferably, intermediate hinges 16 are pivotally connected to the top bed plate along the interior portion of a lengthwise side of the top bed plate and end hinges 17 are pivotally connected to the top bed plate near the ends of the same lengthwise side of the top bed plate. Intermediate hinges 16 and end hinges 17 may be any suitable assembly or construction adapted to permit the pivotal adjustment of the adjustable be plate. It is contemplated within the scope of the invention, however, that the adjustable pile height mechanism comprises only a single bed plate that is pivotally connected to a support structure such as a frame so as to permit the pivotal movement of the single bed plate. It is further contemplated within the scope of the invention that the adjustable pile height mechanism comprises more than two bed plates. As shown in FIG. 4, the preferred end hinges 17 include pin couplers 38 which are placed on the ends of the end hinges.

Figure 5:
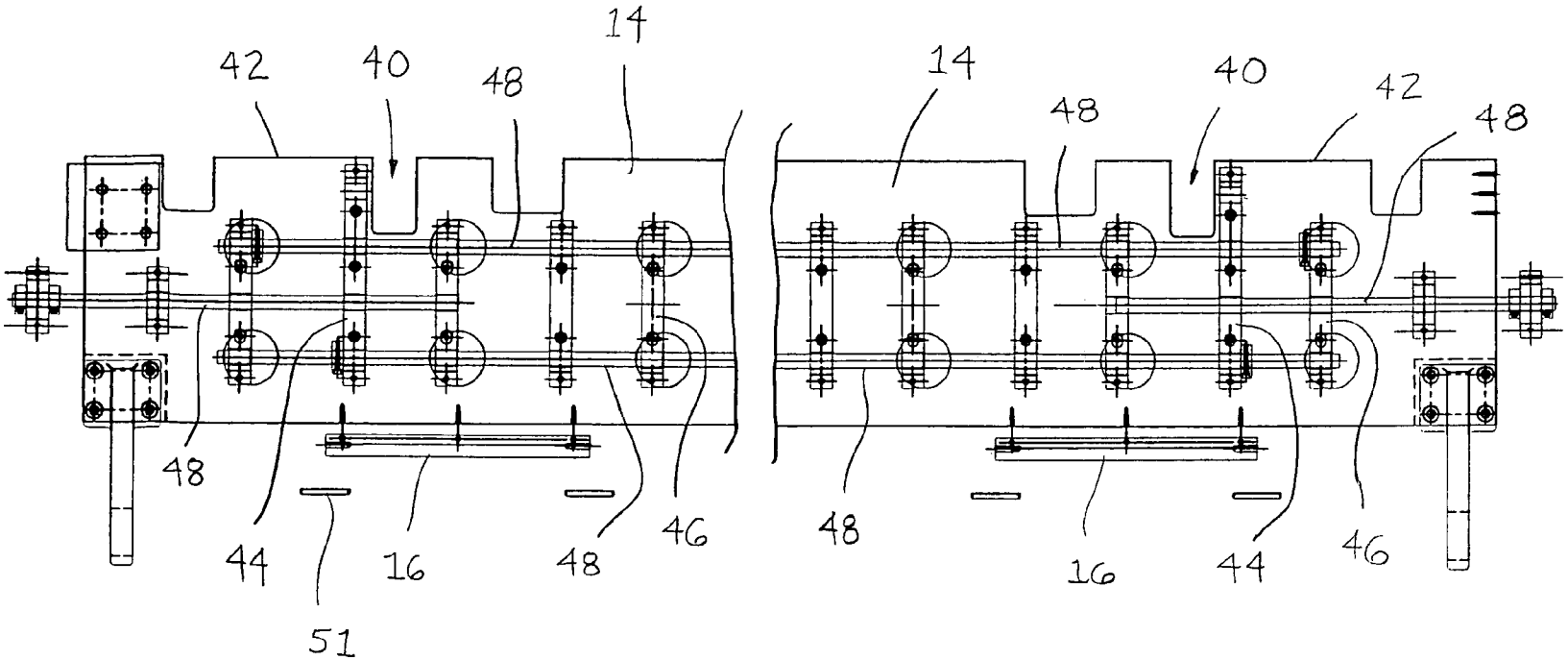
FIG. 5 is a bottom view of the preferred bottom bed plate of the preferred adjustable pile height mechanism in accordance with the present invention.

Referring now to FIG. 5, a bottom view of the preferred bottom bed plate 14 is illustrated. As shown in FIG. 5, the preferred bottom bed plate 14 is configured in the general shape of a rectangle having a plurality of slots 40 along longitudinal side 42. The preferred slots 40 are provided so as to permit a plurality of eccentric cams to directly contact top bed plate 12 as shown in FIG. 2. While FIG. 5 illustrates the preferred configuration and arrangement of the bottom bed plate and the slots, it is contemplated within the scope of the invention that the bottom bed plate and the slots may be configured and arranged in any suitable manner.

Still referring to FIG. 5, the preferred bottom bed plate 14 includes a plurality of bearing supports 44, a plurality of rod supports 46, and a plurality of rods 48. The preferred bearing supports 44 are adapted to support and guide rods 48 and provide support for cam shaft 34, the preferred rod supports 46 are adapted to support rods 48, and the preferred rods 48 are adapted to locate the bottom bed plate on a frame or other support structure. On each end of the preferred bottom bed plate 14, a rod 48 is provided with a plurality of clamp collars 50 which are adapted to position rods 48 on the bottom bed plate. The preferred bottom bed plate 14 also includes a plurality of intermediate hinges 16 adapted to pivotally connect top bed plate 12 to the bottom bed plate. As shown in FIG. 5, the preferred intermediate hinges 16 include dowel pins 51.

Figure 6:
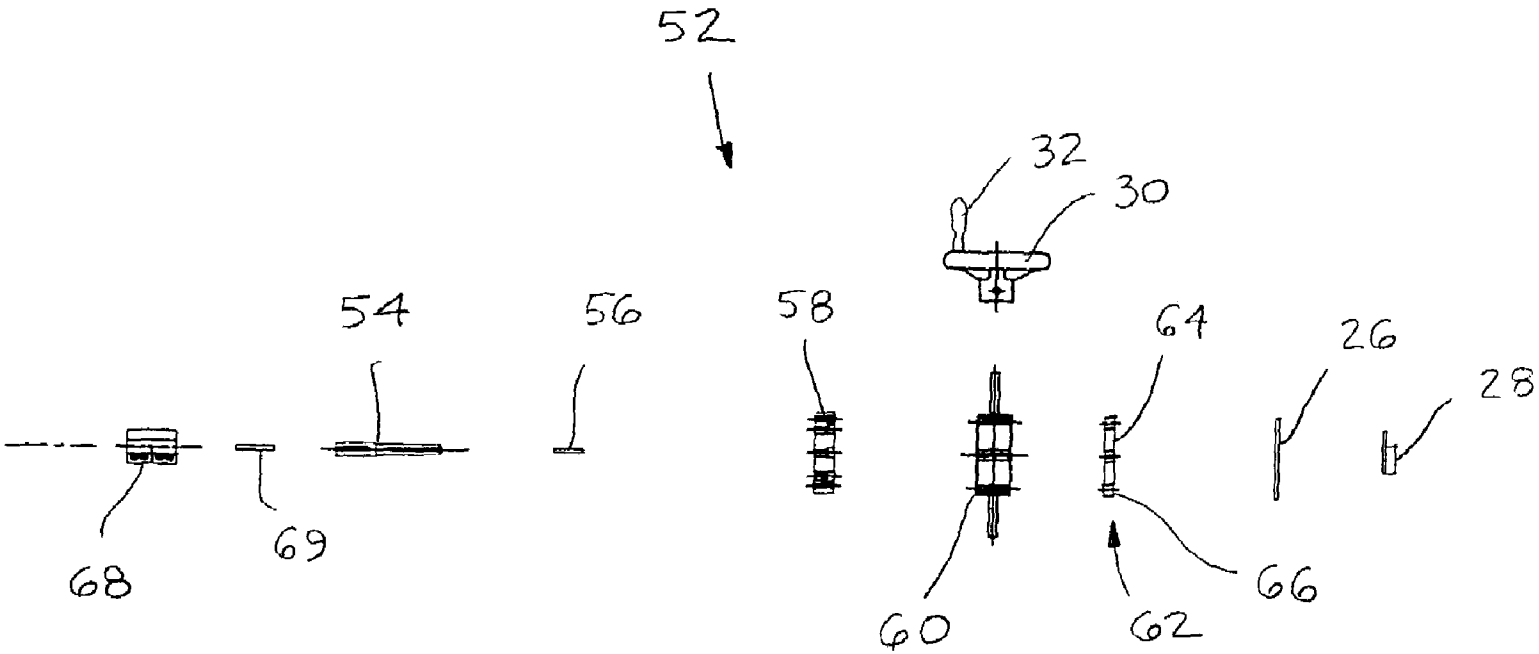
FIG. 6 is an exploded view of the preferred gear assembly of the preferred adjustable pile height mechanism in accordance with the present invention.

Referring now to FIG. 6, an exploded view of the preferred gear assembly is illustrated. As shown in FIG. 6, the preferred gear assembly 52 includes gear box coupling shaft 54, gear box key 56, gear box mounting box 58 and gear box 60. While FIG. 6 illustrates the preferred gear assembly 52, it is contemplated within the scope of the invention that the gear assembly may be any assembly or construction adapted to transmit force and motion to the cam shaft. Also shown in FIG. 6 is the preferred clamp assembly 62 which comprises cam shaft clamp 64 having lock washer 66. The preferred clamp assembly 62 is adapted to control the rotational movement of the cam shaft. More particularly, the preferred clamp assembly is adapted to lock the cam shaft in a fixed position in which rotational movement of the cam shaft is prevented and unlock the cam shaft so as to permit rotational movement of the cam shaft. While FIG. 6 illustrates the preferred clamp assembly, it is contemplated within the scope of the invention that the clamp assembly may be any suitable assembly or construction adapted to control the rotational movement of the cam shaft. The preferred cam shaft coupling 68 and key 69 couple the gear assembly to the cam shaft. It is also contemplated within the scope of the invention that the gear assembly may be coupled to the cam shaft by any suitable assembly or construction. FIG. 6 further illustrates the preferred dial face plate 26 including pointer 28 and the preferred hand wheel 30 including handle 32.

Figure 8:
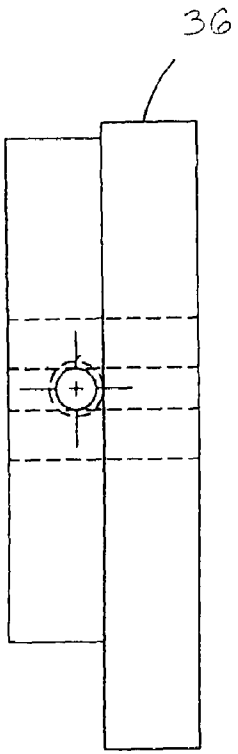
FIG. 8 is a right side view of the exemplary eccentric cam illustrated by FIG. 7.
Figure 7:
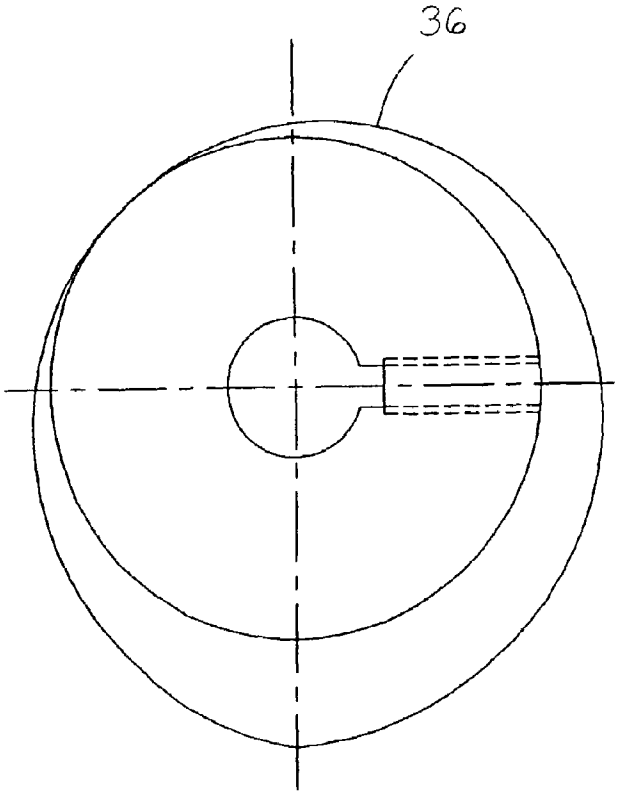
FIG. 7 is a front view of an exemplary eccentric cam in accordance with the present invention.

Referring now to FIG. 7, a front view of an eccentric cam in accordance with the present invention is illustrated. As shown in FIG. 7, the preferred eccentric cam 36 has a smooth, non-linear, curved outer surface that is adapted to permit the adjustment of the adjustable bed plate to an infinite number of desired pile heights within a range of pile heights. FIG. 8 is a right side view of the preferred eccentric cam 36. While FIGS. 7 and 8 illustrate the preferred configuration of eccentric cam 36, it is contemplated within the scope of the invention that the plurality of eccentric cams 36 may be any suitable configuration adapted to permit the adjustment of the adjustable bed plate.

In operation, several advantages of the apparatus and method of the preferred embodiments of the invention are realized. For example, in the preferred embodiment of the apparatus of the invention, an adjustable pile height mechanism for producing a tufted floor covering is provided. The preferred adjustable pile height mechanism comprises an adjustable bed plate, a cam shaft, a clamp assembly for controlling the rotational movement of the cam shaft, a plurality of eccentric cams mounted on the cam shaft so as to be adapted to contact the adjustable bed plate, and a presser foot assembly having a presser foot bracket bolt. The preferred cam shaft is adapted to be rotated so as to rotate the plurality of eccentric cams, and the rotational movement of the plurality of eccentric cams raises and lowers the adjustable bed plate so as to adjust the pile height of the tufted floor covering. The preferred cam shaft is operably connected to a hand wheel by a gear assembly. The preferred adjustable pile height mechanism further comprises a pile height gauge adapted to identify the pile height of the tufted floor covering. Still further, the preferred adjustable bed plate comprises a top bed plate and a bottom bed plate wherein the top bed plate is hingedly connected to the bottom bed plate such that the top bed plate is adapted to be pivotally raised and lowered relative to the bottom bed plate. Thus, the preferred embodiment of the apparatus of the invention provides an adjustable pile height mechanism that is less complex in construction than conventional devices. In addition, the preferred embodiment of the apparatus of the invention permits the user to adjust the pile height of a tufted floor covering to an infinite number of desired pile heights within a range of pile heights.

The preferred method of the invention also achieves several advantages. For example, according to the preferred method for adjusting the pile height of a tufted floor covering, the user loosens the presser foot bracket bolt or bolts, raises the presser foot assembly to permit the adjustable bed plate to be raised or lowered, tightens the presser foot bracket bolt or bolts to a snug fit so as to retain the presser foot assembly at a spaced distance from the adjustable bed plate, disengages the clamp assembly so as to permit the rotational movement of the cam shaft, rotates the cam shaft so as to adjust the adjustable bed plate to the desired pile height, engages the clamp assembly so as to prevent the rotational movement of the cam shaft, loosens the presser foot bracket bolt or bolts, lowers the presser foot assembly to an appropriate position for operation, and tightens the presser foot bracket bolt or bolts so as to retain the presser foot assembly in the operating position. Thus, the preferred method for adjusting the pile height of a tufted floor covering is less complex, less time consuming and less labor intensive than conventional methods. In addition, the preferred method of the invention permits the user to adjust the pile height of a tufted floor covering to an infinite number of desired pile heights within a range of pile heights.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, as would be understood and appreciated by a person having ordinary skill in the art to which the invention relates.

What is claimed is:

1. An adjustable pile height mechanism for producing a tufted floor covering having a substrate, said adjustable pile height mechanism comprising:

(a) an adjustable bed plate;

(b) a cam shaft;

(c) a plurality of eccentric cams mounted on the cam shaft so as to be adapted to contact the adjustable bed plate;

(d) a needle assembly, said needle assembly being adapted to move relative to the substrate of the tufted floor covering;

wherein the cam shaft is adapted to be rotated so as to rotate the plurality of eccentric cams, and wherein the rotational movement of the plurality of eccentric cams raises and lowers the adjustable bed plate so as to adjust the pile height of the tufted floor covering.

2. The adjustable pile height mechanism of claim 1 wherein the adjustable bed plate comprises a top bed plate and a bottom bed plate.

3. The adjustable pile height mechanism of claim 1 wherein the adjustable bed plate is at least approximately six feet in length.

4. The adjustable pile height mechanism of claim 1 wherein the adjustable bed plate is at least approximately twelve feet in length.

5. The adjustable pile height mechanism of claim 1 wherein the cam shaft is operably connected to a hand wheel.

6. The adjustable pile height mechanism of claim 5 wherein the hand wheel includes a handle.

7. The adjustable pile height mechanism of claim 1 wherein the plurality of eccentric cams are mounted on the cam shaft so as to be uniformly spaced along the length of the adjustable bed plate.

8. The adjustable pile height mechanism of claim 5 further comprising a gear assembly operably connected to the cam shaft and the hand wheel, said gear assembly being adapted to rotate the cam shaft upon rotation of the hand wheel.

9. The adjustable pile height mechanism of claim 1 further comprising a hinge that is pivotally mounted to the adjustable bed plate so as to permit the pivotal movement of the adjustable bed plate.

10. The adjustable pile height mechanism of claim 1 further comprising a clamp assembly adapted to control the rotational movement of the cam shaft.

11. The adjustable pile height mechanism of claim 1 further comprising a presser foot assembly including a presser foot bracket bolt.

12. The adjustable pile height mechanism of claim 1 further comprising a pile height gauge adapted to identify the pile height of the tufted floor covering.

13. An adjustable pile height mechanism for producing a tufted floor covering, said adjustable pile height mechanism comprising:

(a) a top bed plate and a bottom bed plate, said top bed plate being hingedly connected to the bottom bed plate such that the top bed plate is adapted to be pivotally raised and lowered relative to the bottom bed plate;

(b) a cam shaft that is operably connected to a hand wheel by a gear assembly;

(c) a clamp assembly for controlling the rotational movement of the cam shaft;

(d) a plurality of eccentric cams mounted on the cam shaft so as to be uniformly spaced along the cam shaft, said plurality of eccentric cams being adapted to contact the top bed plate;

wherein the cam shaft is adapted to be rotated so as to rotate the plurality of eccentric cams, and wherein the rotational movement of the plurality of eccentric cams raises and lowers the top bed plate so as to adjust the pile height of the tufted floor covering.

14. The adjustable pile height mechanism of claim 13 wherein the hand wheel includes a handle.

15. The adjustable pile height mechanism of claim 13 further comprising a presser foot assembly including a presser foot bracket bolt.

16. The adjustable pile height mechanism of claim 13 further comprising a pile height gauge adapted to identify the pile height of the tufted floor covering.

17. A method for adjusting the pile height of a tufted floor covering, said method comprising:

(a) providing an adjustable pile height mechanism for producing a tufted floor covering, said adjustable pile height mechanism comprising:

(1) an adjustable bed plate;

(2) a cam shaft;

(3) a clamp assembly for controlling the rotational movement of the cam shaft;

(4) a plurality of eccentric cams mounted on the cam shaft so as to be adapted to contact the adjustable bed plate;

(5) a presser foot assembly having a presser foot bracket bolt;

wherein the cam shaft is adapted to be rotated so as to rotate the plurality of eccentric cams, and wherein the rotational movement of the plurality of eccentric cams raises and lowers the adjustable bed plate so as to adjust the pile height of the tufted floor covering;

(b) loosening the presser foot bracket bolt;

(c) raising the presser foot assembly;

(d) tightening the presser foot bracket bolt;

(e) disengaging the clamp assembly;

(f) rotating the cam shaft so as to adjust the adjustable bed plate to the desired pile height;

(g) engaging the clamp assembly;

(h) loosening the presser foot bracket bolt;

(i) lowering the presser foot assembly;

(j) tightening the presser foot bracket bolt.

18. The method of claim 17 wherein the cam shaft is operably connected to a hand wheel by a gear assembly.

19. The method of claim 17 wherein the adjustable pile height mechanism further comprises a pile height gauge adapted to identify the pile height of the tufted floor covering.

20. The method of claim 17 wherein the adjustable bed plate comprises a top bed plate and a bottom bed plate, said top bed plate being hingedly connected to the bottom bed plate such that the top bed plate is adapted to be pivotally raised and lowered relative to the bottom bed plate.

* * * * *